US008161863B1

(12) United States Patent
Haas

(10) Patent No.: US 8,161,863 B1
(45) Date of Patent: Apr. 24, 2012

(54) RECOIL-ACTUATED GUN SCAVENGER

(75) Inventor: Jeffrey W. Haas, Loudonville, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 12/966,062

(22) Filed: Dec. 13, 2010

(51) Int. Cl.
*F41A 25/00* (2006.01)

(52) U.S. Cl. ..... 89/43.01; 89/42.01; 89/1.2; 89/193

(58) Field of Classification Search ..... 89/42.01, 89/43.01, 1.2, 1.7, 1.703, 191.01, 192, 193
See application file for complete search history.

(56) References Cited

U.S. PATENT DOCUMENTS 3,122,055 A * 2/1964 Roeck, Sr. ..... 89/1.2
3,715,955 A * 2/1973 Folley et al. ..... 89/193
3,964,365 A * 6/1976 Zielinski ..... 89/43.01
3,991,650 A * 11/1976 Garland et al. ..... 89/43.01
4,150,819 A * 4/1979 Taylor ..... 267/136
4,296,670 A * 10/1981 Northup et al. ..... 89/43.01
4,656,921 A * 4/1987 Zierler ..... 89/43.01
5,042,360 A * 8/1991 Burmeister et al. ..... 89/12
5,078,045 A * 1/1992 Audino et al. ..... 89/43.01
5,168,120 A * 12/1992 Rossel ..... 89/43.01
5,404,789 A * 4/1995 Haas ..... 89/1.2
6,178,866 B1 * 1/2001 Searle et al. ..... 89/37.08
6,802,406 B2 * 10/2004 Martin ..... 188/274
7,798,044 B2 * 9/2010 Webb ..... 89/1.2
8,061,259 B1 * 11/2011 Searle et al. ..... 89/43.01
2009/0126558 A1 * 5/2009 Kohnen ..... 89/43.01

* cited by examiner

*Primary Examiner* — Michelle Clement
(74) *Attorney, Agent, or Firm* — Michael C. Sachs

(57) ABSTRACT

A recoil-actuated gun scavenger for a gun having a bore, a breech, a recoiling mass, and a non-recoiling mass. The scavenger may include a pneumatic cylinder and a piston translatable therein. A rod may be fixed to the piston. The cylinder and rod may be fixed to respective recoiling and non-recoiling masses, or vice versa. The cylinder may include intake and exhaust ports with check valves, on both sides of the piston. The exhaust ports may communicate with an accumulator. The accumulator may discharge compressed air to jets located at the open breech end of the gun.

12 Claims, 2 Drawing Sheets

RECOIL-ACTUATED GUN SCAVENGER

STATEMENT OF GOVERNMENT INTEREST

The inventions described herein may be manufactured, used and licensed by or for the U.S. Government for U.S. Government purposes.

BACKGROUND OF THE INVENTION

The invention relates in general to large caliber gun tubes and in particular to the evacuation of propellant gas from such tubes.

Modem armored vehicles, such as tanks and self propelled howitzers, generally have a large caliber gun as the main armament. The breech of the gun may be located within a manned, closed-cab vehicle. After firing a round, residual propellant gases in the gun must be evacuated from the bore to prevent them from entering the cab of the vehicle. Propellant gases may contain noxious components such as carbon monoxide, nitric acid, and ammonia. If the propellant gases enter the vehicle compartment, they may pose a hazard to the crew. In addition, the fuel-rich propellant gases may spontaneously combust (known as "flareback") when they contact the air in the cab. Various means of purging propellant gases from the bores of guns have been developed and used over the years.

A conventional approach to this problem has been the integration of a reservoir (alternatively called a bore evacuator or a fume extractor) located approximately mid-bore and tapped into the bore by a series of ports angled towards the muzzle. During the firing cycle, propellant gases enter the angled ports and charge the reservoir to approximately 100 psi. After firing the round, the pressure in the bore drops to atmospheric, the process reverses itself, and gases begin to discharge back into the bore through the angled ports. The action of this process is such that, when the breech is opened, air from the cab is entrained at the breech into the bore and the residual propellant gases are ejected out the muzzle. Because this process happens very rapidly (the entire cycle lasts approximately one second), the timing of the breech opening is crucial to performance.

Armored systems which use bore evacuators or fume extractors are recognizable by the characteristic reservoir located approximately mid-bore of the main armament. Such systems are advantageous because of their passive operation and can be very effective if properly maintained. However, there are some deficiencies in the conventional evacuators.

To be effective, such a system must be able to operate over a rather wide range of propellant charge pressures. In tank guns, the system must be capable of effectively evacuating the bore with standard high pressure rounds, as well as newer low pressure rounds. Artillery systems typically also use varying charge zones which can vary over an order of magnitude in pressure.

In addition, the trend towards lighter-weight guns necessitates longer recoil and hence, delayed breech opening. Delayed breech opening limits effectiveness of the conventional evacuator. The conventional bore evacuator must be significantly over-designed to properly function under a wide variety of conditions. Consequently, conventional evacuators may be complicated, heavy devices that may add undue weight to the weapon system, adversely affect the center of gravity of the vehicle or system, and require maintenance. The location of the bore evacuator (external to the vehicle) also makes them vulnerable to damage. A single puncture from small arms fire, shrapnel, or impact can render the bore evacuator non-functional. For effective operation, such systems may require cleaning and maintenance after each firing day.

A need exists for a bore evacuator that is more efficient over a range of propellant charge pressures, less vulnerable to damage, and requires less maintenance than a conventional bore evacuator.

SUMMARY OF THE INVENTION

It is an object of the invention to provide a gun scavenger that is efficient over a wide range of propellant charge pressures, is less vulnerable to damage than conventional bore evacuators, and requires little maintenance.

One aspect of the invention is a recoil-actuated gun scavenger for a gun having a bore, a breech, a recoiling mass, and a non-recoiling mass. The scavenger may include a pneumatic cylinder having a piston disposed therein. The cylinder and the piston may be translatable with respect to each other. The cylinder may be fixed to one of the recoiling mass and the non-recoiling mass. A rod may have one end fixed to the piston and another end fixed to another of the recoiling mass and the non-recoiling mass.

The scavenger may include a pair of air intake ports in the cylinder and a pair of air exhaust ports in the cylinder. The pair of intake ports may be disposed on opposite sides of the piston. Each intake port may include a one-way valve. The pair of air exhaust ports may be disposed on opposite sides of the piston. Each exhaust port may include a one-way valve. An air accumulator may be in fluid communication with the pair of exhaust ports. A discharge valve may be in fluid communication with the air accumulator. The discharge valve may have an open position and a closed position.

At least one jet may be disposed at a breech end of the bore of the gun. The at least one jet may be in fluid communication with the discharge valve. Air that is compressed into the accumulator by the piston may be discharged from the at least one jet into the breech end of the bore when the breech of the gun opens. The piston may compress air into the accumulator on both recoil and counter recoil strokes.

The discharge valve may be disposed on the non-recoiling mass. The discharge valve may open and close by relative translation of the recoiling mass and the non-recoiling mass. The discharge valve may be closed when the gun is out of battery and open when the gun is in battery. The recoiling mass may open the discharge valve by contact. The discharge valve may be spring-biased to the closed position.

In one embodiment, the accumulator may be a single-chamber accumulator. In another embodiment, the accumulator may include two chambers separated by a movable accumulator piston.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A gun scavenger may utilize the recoil action of a weapon to compress a quantity of air. The compressed air may be delivered to the gun bore through jets located at the breech end of the gun. The compressed air may effectively purge the gun bore of residual propellant gases.

Figure 1:
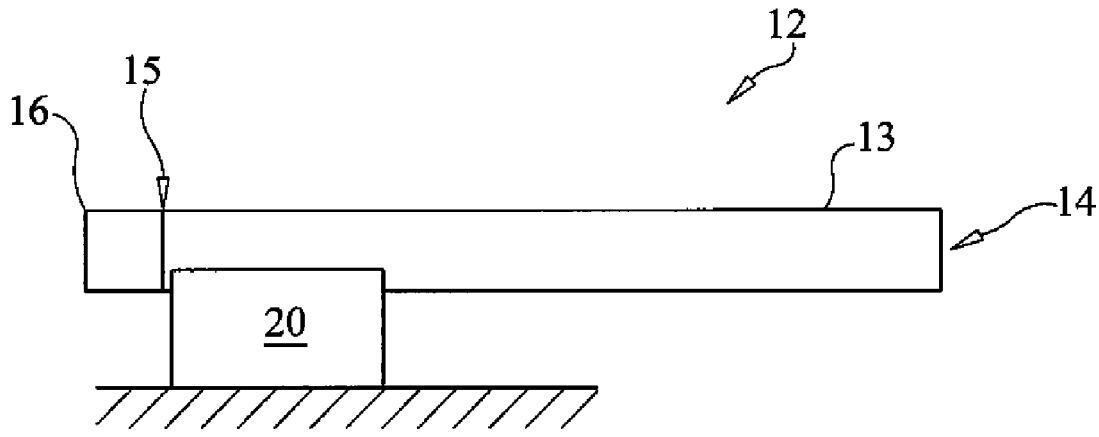
FIG. 1 PRIOR ART
FIG. 1 is a schematic diagram of a weapon having a gun tube.

FIG. 1 is a schematic diagram of a weapon 12 having a gun tube 13. Weapon 12 may be used, for example, to launch large caliber projectiles out of gun tube 13. Gun tube 13 may include a bore 14, and a breech 16 at a breech end 15 of bore 14. Gun tube 13 may be mounted to a non-recoiling mass 20, for example, a gun cradle. The recoiling mass of weapon 12 may include the breech 16 and gun tube 13.

Figure 2:
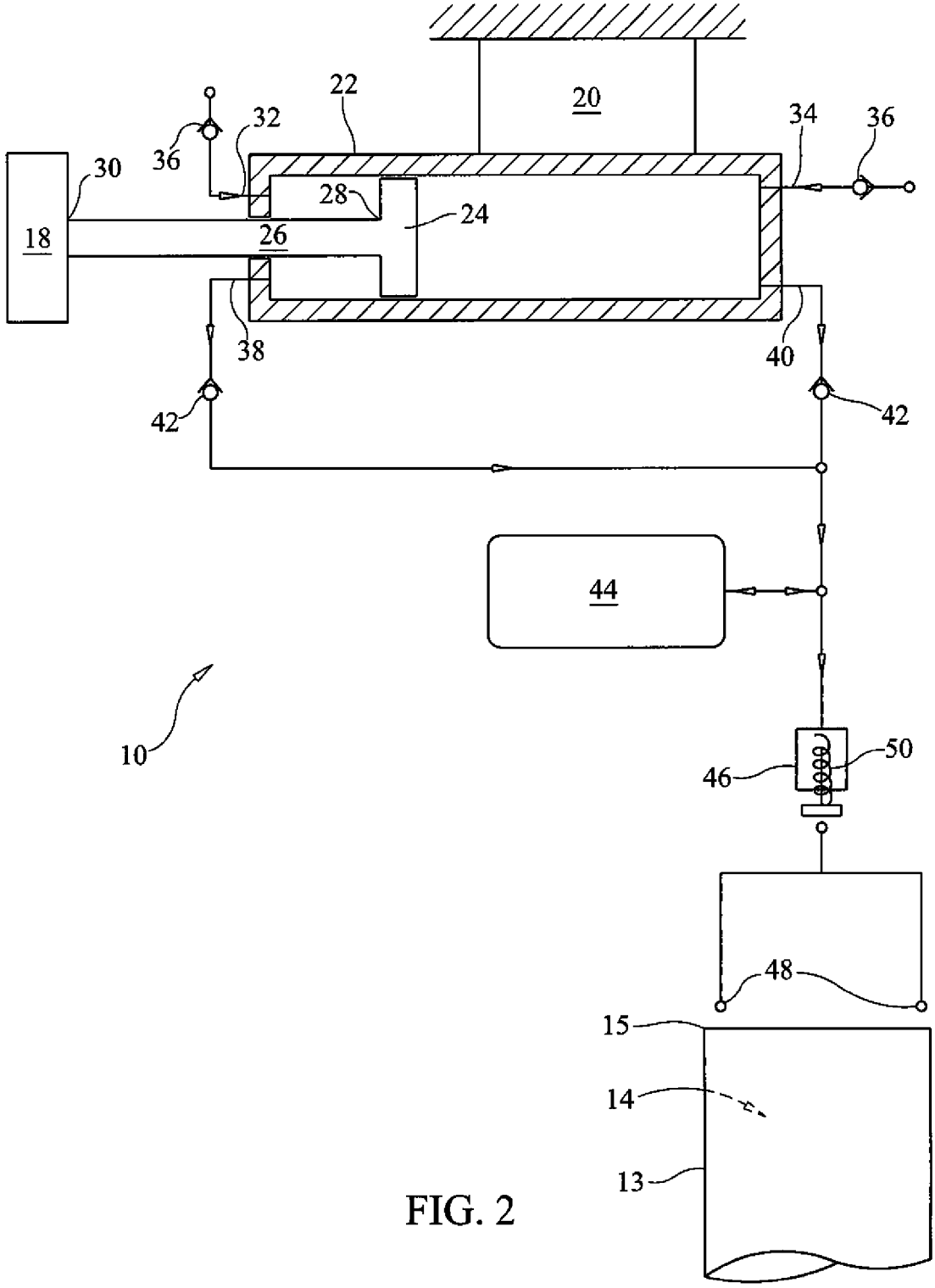
FIG. 2 is a schematic diagram of an embodiment of a recoil-actuated gun scavenger.

FIG. 2 is a schematic diagram of an embodiment of a recoil-actuated gun scavenger 10. Scavenger 10 may include a pneumatic cylinder 22 having a piston 24 disposed therein. Cylinder 22 and piston 24 may be translatable with respect to each other. Cylinder 22 may be fixed to non-recoiling mass 20. A rod 26 may have one end 28 fixed to piston 24 and another end 30 fixed to recoiling mass 18. Recoiling mass 18 may include, for example, breech 16 and gun tube 13. Alternatively, cylinder 22 may be fixed to recoiling mass 18 and end 30 of rod 26 may be fixed to non-recoiling mass 20. For clarity, the pneumatic components are shown schematically in FIG. 2. It should be understood that the recoiling mass 18 may include breech 16 and gun tube 13, notwithstanding that gun tube 13 is shown schematically in FIG. 2 as spatially apart from recoiling mass 18.

Cylinder 22 may include a pair of air intake ports 32, 34. Intake ports 32, 34 may be disposed on opposite sides of piston 24. Each intake port 32, 34 may include a one-way valve 36. Cylinder 22 may include a pair of air exhaust ports 38, 40. Exhaust ports 38, 40 may be disposed on opposite sides of piston 24. Each exhaust port 38, 40 may include a one-way valve 42.

An air accumulator 44 may be in fluid communication with exhaust ports 38, 40. A discharge valve 46 may be in fluid communication with air accumulator 44. Discharge valve 46 may have open and closed positions. Discharge valve 46 may be in fluid communication with jets 48. Jets 48 may be disposed at breech end 15 of gun bore 14. Scavenger 10 may include at least one jet 48 or a plurality of jets 48. Ambient air compressed into accumulator 44 by piston 24 may be discharged from jets 48 into breech end 15 of gun bore 14, when breech 16 opens.

Piston 24 may compress air into accumulator 44 on both recoil and counter recoil strokes. Discharge valve 46 may be disposed on non-recoiling mass 20. Discharge valve 46 may be opened and closed by relative translation of recoiling mass 18 and non-recoiling mass 20. Discharge valve 46 may be closed when gun tube 13 is out of battery. As the gun tube 13 returns to battery, discharge valve 46 may open to allow air in accumulator 44 to enter jets 48. Compressed air may exit jets 48 into breech end 15 and force residual propellant gases in bore 14 out of the muzzle of tube 13.

In one embodiment, discharge valve 46 may be disposed on non-recoiling mass 20, and recoiling mass 18 may open discharge valve 46 by contact. Discharge valve 46 may include a spring 50 that biases valve 46 to the closed position.

Figure 3:
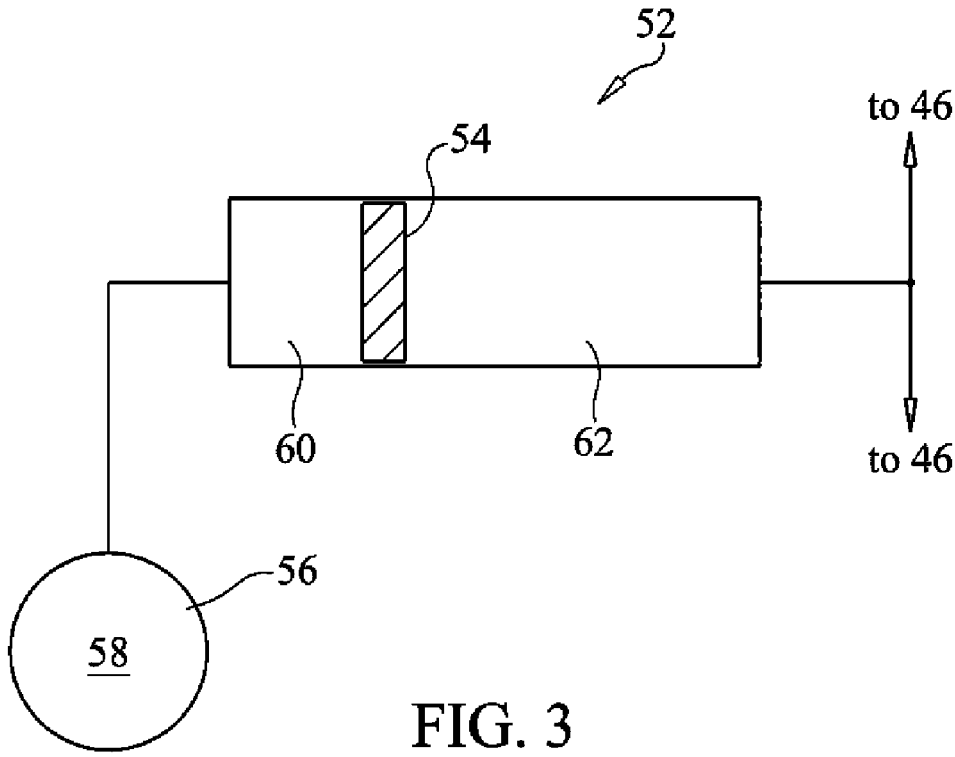
FIG. 3 is a schematic diagram of an alternative accumulator for the scavenger of FIG. 2.

Accumulator 44 may be a single-chamber, constant volume accumulator. Alternatively, as shown in FIG. 3, an accumulator 52 with two chambers 60, 62 may be used. Chambers 60, 62 may be separated by a movable piston 54. A constant pressure gas reservoir 56 may be in fluid communication with accumulator chamber 60. Constant pressure gas reservoir 56 may contain an inert gas 58, such as nitrogen. To maintain substantially constant pressure in accumulator 52, the volume of reservoir 56 may be greater than the volume of accumulator 52, for example, five to ten times greater.

Accumulator 52 may pre-charged via reservoir 56 to a determined pre-charge pressure. During the discharge cycle, air may be forced at substantially constant pressure by the action of piston 54 through jets 48. Thus, accumulator 52 may allow scavenger 10 to operate at lower pressures and more efficiently than accumulator 44.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A recoil-actuated gun scavenger for a gun having a bore, a breech, a recoiling mass, and a non-recoiling mass, the scavenger comprising:

a pneumatic cylinder having a piston disposed therein, the cylinder and the piston being translatable with respect to each other, the cylinder being fixed to one of the recoiling mass and the non-recoiling mass;

a rod having one end fixed to the piston and another end fixed to another of the recoiling mass and the non-recoiling mass;

a pair of air intake ports in the cylinder, the pair of intake ports being disposed on opposite sides of the piston, each intake port including a one-way valve;

a pair of air exhaust ports in the cylinder, the pair of exhaust ports being disposed on opposite sides of the piston, each exhaust port including a one-way valve;

an air accumulator in fluid communication with the pair of exhaust ports;

a discharge valve in fluid communication with the air accumulator, the discharge valve having an open position and a closed position; and at least one jet disposed at a breech end of the bore of the gun, the at least one jet being in fluid communication with the discharge valve;

wherein air compressed into the accumulator by the piston is discharged from the at least one jet into the breech end of the bore when the breech of the gun opens.

2. The scavenger of claim 1, wherein the at least one jet includes a plurality of jets.

3. The scavenger of claim 1, wherein the piston compresses air into the accumulator on both recoil and counter recoil strokes.

4. The scavenger of claim 1, wherein the discharge valve is disposed on the non-recoiling mass and further wherein the discharge valve opens and closes by relative translation of the recoiling mass and the non-recoiling mass.

5. The scavenger of claim 4, wherein the discharge valve is closed when the gun is out of battery and open when the gun is in battery.

6. The scavenger of claim 5, wherein the recoiling mass opens the discharge valve by contact.

7. The scavenger of claim 6, wherein the discharge valve is spring-biased to the closed position.

8. The scavenger of claim 1, wherein the accumulator is a single-chamber accumulator.

9. The scavenger of claim 1, wherein the accumulator includes two chambers separated by a movable accumulator piston.

10. The scavenger of claim 9, further comprising a constant pressure gas reservoir in fluid communication with one of the accumulator chambers.

11. The scavenger of claim 10, wherein the constant pressure gas reservoir contains an inert gas.

12. The scavenger of claim 9, wherein a volume of the constant pressure gas reservoir is at least about five times as large as a volume of the accumulator.

* * * * *